United States Patent [19]

Barclay

[11] Patent Number: 4,682,522

[45] Date of Patent: Jul. 28, 1987

[54] SHEARING METHOD AND MACHINE FOR SEGMENTING SCRAP TIRES

[76] Inventor: Randel L. Barclay, 5616 Carpenter Rd., Stockton, Calif. 95205

[21] Appl. No.: 924,289

[22] Filed: Oct. 29, 1986

[51] Int. Cl.[4] ..... B26D 7/06; B26D 7/08

[52] U.S. Cl. ..... 83/19; 83/176; 83/404.2; 83/435.2; 83/508.3; 83/923; 83/925 R; 83/928; 241/DIG. 31

[58] Field of Search ..... 83/923, 925 R, 928, 83/13, 19, 176, 187, 404, 404.1, 404.2, 404.4, 425.2, 425.3, 435.2, 500, 508.3; 241/DIG. 31

[56] References Cited

U.S. PATENT DOCUMENTS

| | | | |
|---|---|---|---|
| 2,567,634 | 9/1951 | Bosshard | 164/60 |
| 3,460,419 | 8/1969 | Branick | 83/185 |
| 3,496,812 | 2/1970 | White et al. | 83/13 |
| 3,911,772 | 10/1975 | Kisielewski | 83/278 |
| 4,052,013 | 10/1977 | Ehrlich et al. | 241/101.2 |
| 4,134,556 | 1/1979 | Ehrlich et al. | 241/79.3 |
| 4,338,839 | 7/1982 | Farrell, Sr. et al. | 83/620 |
| 4,338,840 | 7/1982 | Farrell, Sr. et al. | 83/622 |
| 4,374,573 | 2/1983 | Rouse et al. | 241/DIG. 31 |
| 4,405,090 | 9/1983 | Wakeem | 83/923 X |
| 4,418,594 | 12/1983 | Burns | 83/19 |
| 4,607,800 | 8/1986 | Barclay | 241/DIG. 31 |

FOREIGN PATENT DOCUMENTS 937226 6/1982 U.S.S.R. .

*Primary Examiner*—Donald R. Schran
*Attorney, Agent, or Firm*—Thomas Schneck

[57] ABSTRACT

An apparatus for segmenting scrap tires having a compression conveyor and three rotary shears that make perpendicular cuts into the tire. The compression conveyor centers the tire and provides forces onto the treaded periphery to buckle the tire. The compression feeds the tire to a first rotary shear having overlapping counterrotating circular shears that make at least one cut about the circumferential periphery of the tire to produce annular tire segments. The annular tire segments fall by gravity into a conveyor having a pair of auger flights which position the segments for pickup by a conveyor chain. The conveyor chain includes a number of hooks which grasp the inner circumference of the annular tire segments, whereupon they are centered for entry into a second and third rotary shear. The second and third rotary shears are parallel to each other and are disposed to shear the tire segments perpendicularly to an axis extending through the center of the segment, reducing the tire segment to four arcuate segments. Preferably the first rotary shear includes a pair of coaxial circular shears that are spaced apart by a third shear supported on a shaft parallel a shaft supporting the outer shears. The second and third rotary shears each have a pair of shears supported on parallel shafts. In this manner a scrap tire will be reduced to twelve arcuate segments. Adjacent shears are spaced apart from each other by a distance not exceeding 0.003 inches.

21 Claims, 10 Drawing Figures

SHEARING METHOD AND MACHINE FOR SEGMENTING SCRAP TIRES

TECHNICAL FIELD

The present invention relates to apparatus for reducing scrap tires into segments suitable for further reduction in other equipment.

BACKGROUND ART

To date the problems of disposing, burning and transporting discarded tires are many and varied. In recycling tires for fuel, the most utilized method is cutting scrap tires into two inch chips. This has generally proved not to be cost effective since the cost of collecting, transporting and cutting the tires is more than the return in value as fuel.

The dimensions of a tire make it difficult to stack tires in a low volume consuming manner. In transporting tires to a recycling plant, motor trucks at times carry only one-half a full load by weight. Since a motor truck not loaded to its full weight potential costs very nearly as much to operate as one that is, the cost effectiveness of recycling scrap tires may be increased by increasing the weight load carried by the motor truck.

The weight load of scrap tires that may be carried by a motor truck can be increased by providing a mobile cutting apparatus that cuts the scrap tires into smaller pieces before the tires are placed within the motor vehicle. U.S. Pat. No. 3,911,772 to Kisielewski discloses a mobile material cutter that makes a diametrical cut across a tire to half the tire. While this halving of a tire permits an increased weight load for motor trucks, a full load is still not possible. U.S. Pat. Nos. 4,338,839 and 4,338,840 to Farrell, Sr. et al. disclose portable cutting machines which quarter a tire by means of a hydraulic cylinder ram which drives blades into the tire. It has been shown, however, that quartering a tire will still not permit full load transportation.

Mobile machinery that reduces a worn tire to two inch chips is known. But such machinery typically is cost prohibitive for the return in value of fuel because of the amount of energy needed to operate the machinery, as well as its bulk. Not all scrap tires are recycled. Many tires are buried in land fills. Strict regulations have been enacted to govern burial of discarded tires. Tire carcasses have an inherent resistance to burial or compaction and, therefore, it is required that a tire be cut into a number of segments prior to burial. U.S. Pat. No. 3,460,419 to Branick describes an apparatus for cutting away the side walls from the crown portion of a tire. The apparatus, however, is labor intensive since an operator cuts one tire at a time after placing the tire over a cylindrical drum.

An object of the present invention is to provide an apparatus which significantly increases the load of used tires that may be carried by a motor truck. A further object is to provide such an apparatus which has a low operating cost and a high degree of portability.

DISCLOSURE OF THE INVENTION

The above objects have been met by a tire shearing machine that sufficiently segments a scrap tire to increase the weight load carried in a motor truck by approximately fifty percent. The shearing machine produces sequential cuts in perpendicular directions that render tires more easily transported or buried, or more readily reduced to even smaller pieces for burning.

A compression conveyor feeds the uncut scrap tires into the first rotary shear. The compression conveyor centers the tire and at the same time provides forces which compress the scrap tires in relation to the treaded periphery of the tires. The compression conveyor may be a plurality of horizontal and vertical rollers that form a funnel-like configuration leading to the first rotary shear. Alternatively, the compression conveyor may have a plurality of spaced apart paddle assemblies which feed the first rotary shear.

A first rotary shear, having overlapping counterrotating circular shears, is positioned to make at least one separation about the circumferential periphery of tire, thereby producing annular tire segments. After the first rotary shear has reduced a scrap tire to annular segments, the segments fall by gravity into a conveyor having a pair of auger flights which position the segments for pickup by a conveyor chain. The conveyor chain includes a number of hooks which grasp the inner circumference of the annular tire segments. The hooks carry a tire segment to a second and a third rotary shear. The second and third rotary shears are parallel to each other and are disposed to shear the tire segments perpendicularly to an axis extending through the center, reducing the tire segment to four arcuate segments.

The shearing machine cuts a scrap tire to produce at least eight arcuate segments. Preferably, the first rotary shear includes two coaxial circular shears that are spaced apart by a middle circular shear that counterrotationally overlaps the two coaxial shears. In this manner the rotary shear produces three annular tire segments, with the side walls remaining intact and a mid-portion of the tire that is the width of the middle circular shear comprising the third annular segment. When the three annular segments are run through the second and third rotary shears a total of twelve arcuate segments are produced.

Through a series of chains and sprockets a motor of between 10 hp and 30 hp will operate the entire shear machine so that the machine has a low operating cost. Alternatively, a plurality of motors having an aggregate power of between 10 and 30 hp may be employed. The shearing machine segments the tire into at least eight parts so that the inherent resistance of a tire to burial or compaction is reduced and the transportation load may be increased by an average of fifty percent. Where it is desirable to reduce scrap tires to 2 inch chips, a small stationary shredder at a recycling plant may be used to finish the reduction.

Segmentation of a scrap tire by first making a cut about the circumferential periphery facilitates removal of the tire's bead wire and permits removal of dirt, water and other non-rubber materials from the tire casing prior to introduction to a combustion chamber. The present invention provides a new method for shearing tires in which a tire is first flattened by circumferential pressure about the tire periphery bringing opposed tread regions into proximity. The flattened tire is sheared about the circumferential periphery, i.e. in a plane parallel to the plane of the tread thereby forming two annular tire sections. Next, shearing cuts are made across each annular tire section, reducing each section into at least two pieces and preferably four pieces. Preferably, two parallel shearing cuts are made across each annular tire section, with the spacing of the cuts being less than the inside diameter of the tire. A pair of such cuts across the tire half produces four pieces. In this manner, a tire is reduced to eight sections and is suitable for further reduction by other equipment.

BEST MODE FOR CARRYING OUT THE INVENTION

Figure 1:
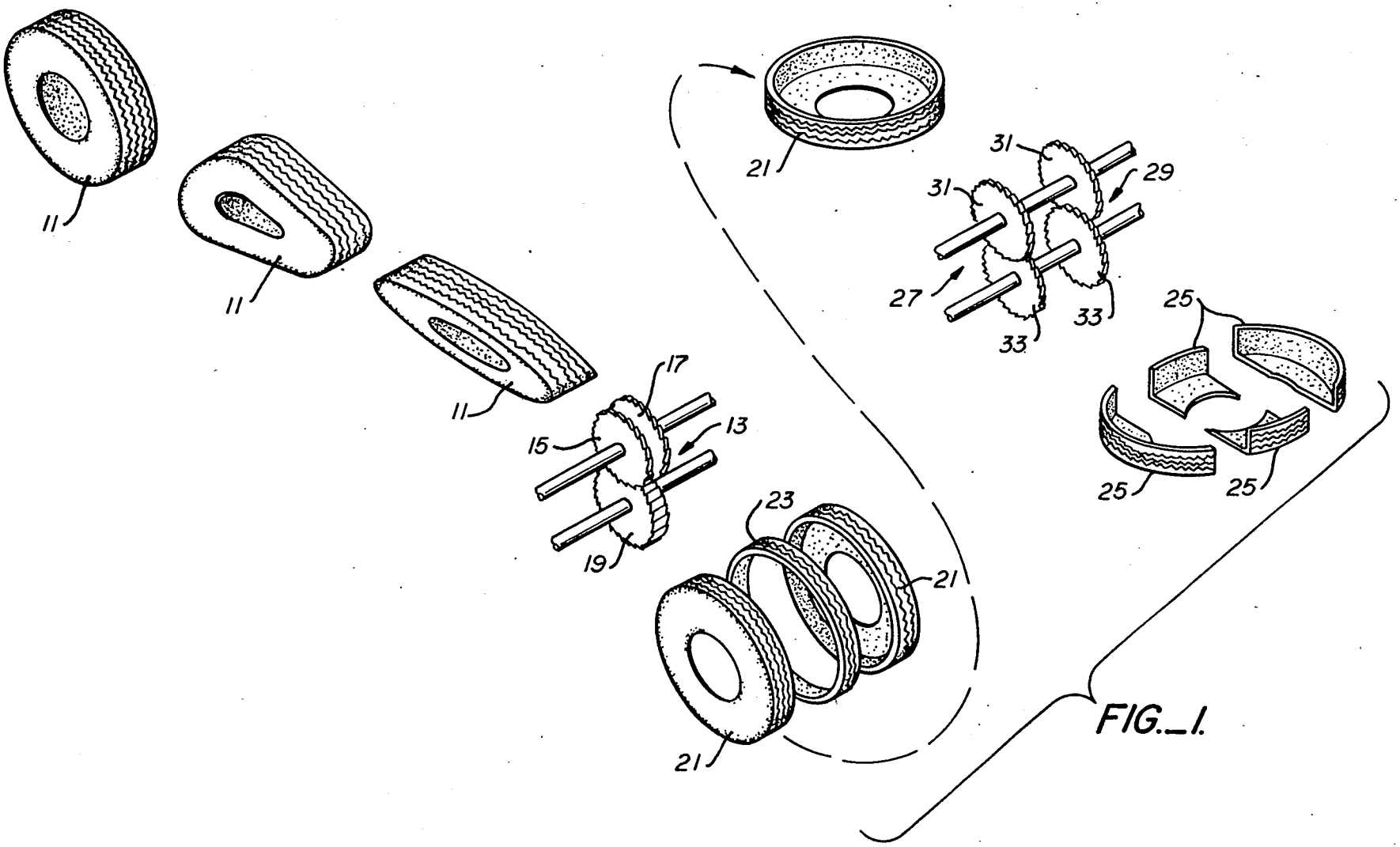
FIG. 1 is a plan view of the tire shearing operation carried out by apparatus of the present invention.

With reference to FIG. 1, a tire 11 is fed into a first rotary shear 13. The tire 11 is compressed before reaching the rotary shear. The first rotary shear 13 has a pair of coaxially mounted circular shears 15, 17 which are rotated in a direction opposite of a middle shear 19. The three shears may be either closely spaced or contacting to achieve shearing action. The first rotary shear 13 cuts the tire 11 into three annular segments—two side wall segments 21 and a crown segment 23.

Each annular tire segment is then sheared into four arcuate parts 25 by a second 27 and a third 29 rotary, interleaving shear. The second and third rotary shears 27 and 29 each have a pair of counterrotating shears 31 and 33 that cut an annular tire segment 21. The construction of interleaving rotary shears in known. See U.S. Pat. No. 4,607,800 to R. L. Barclay, for example, incorporated by reference herein.

Figure 2:
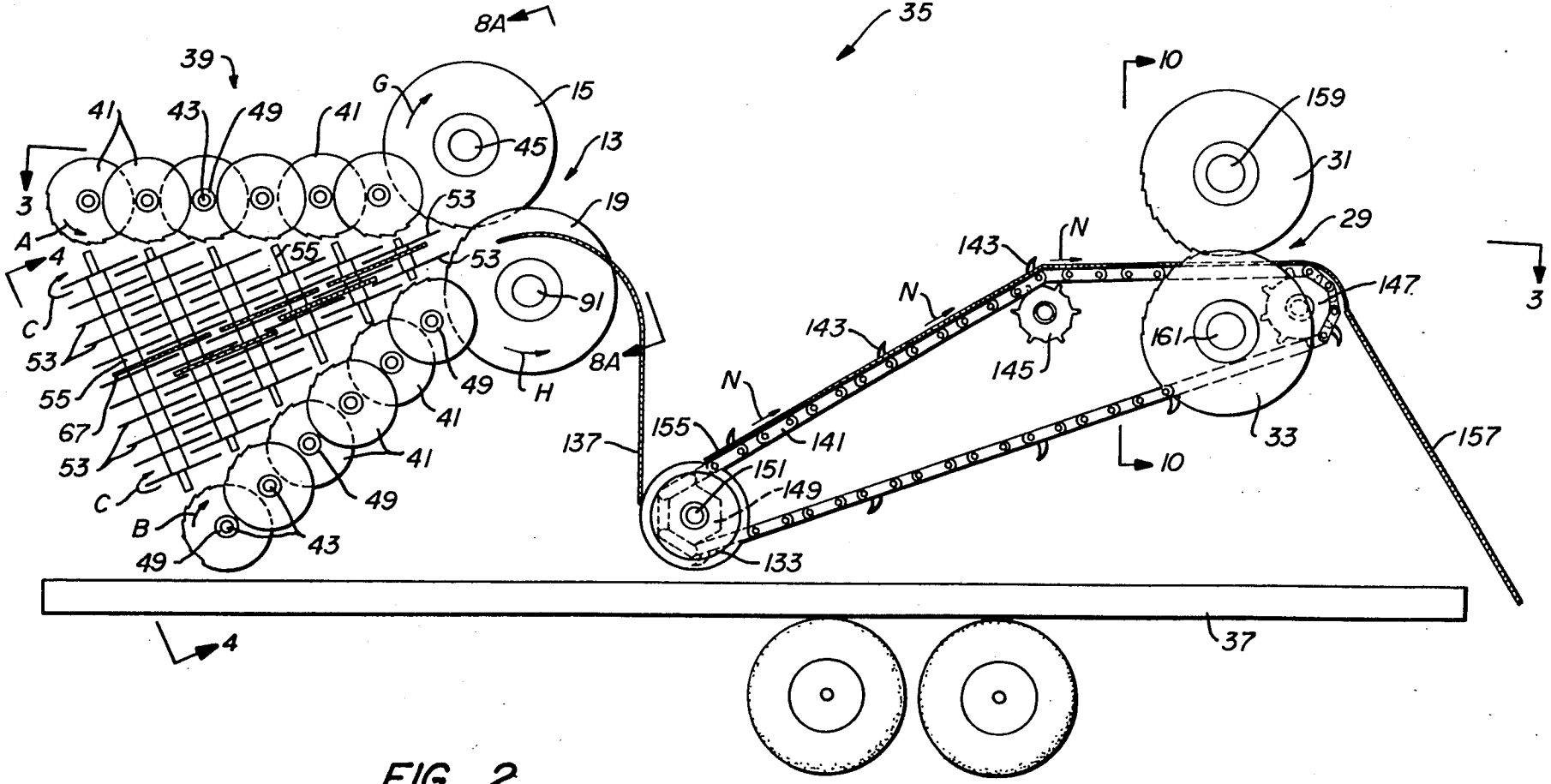
FIG. 2 is a side plan view of a mobile shearing apparatus in the present invention.
Figure 3:
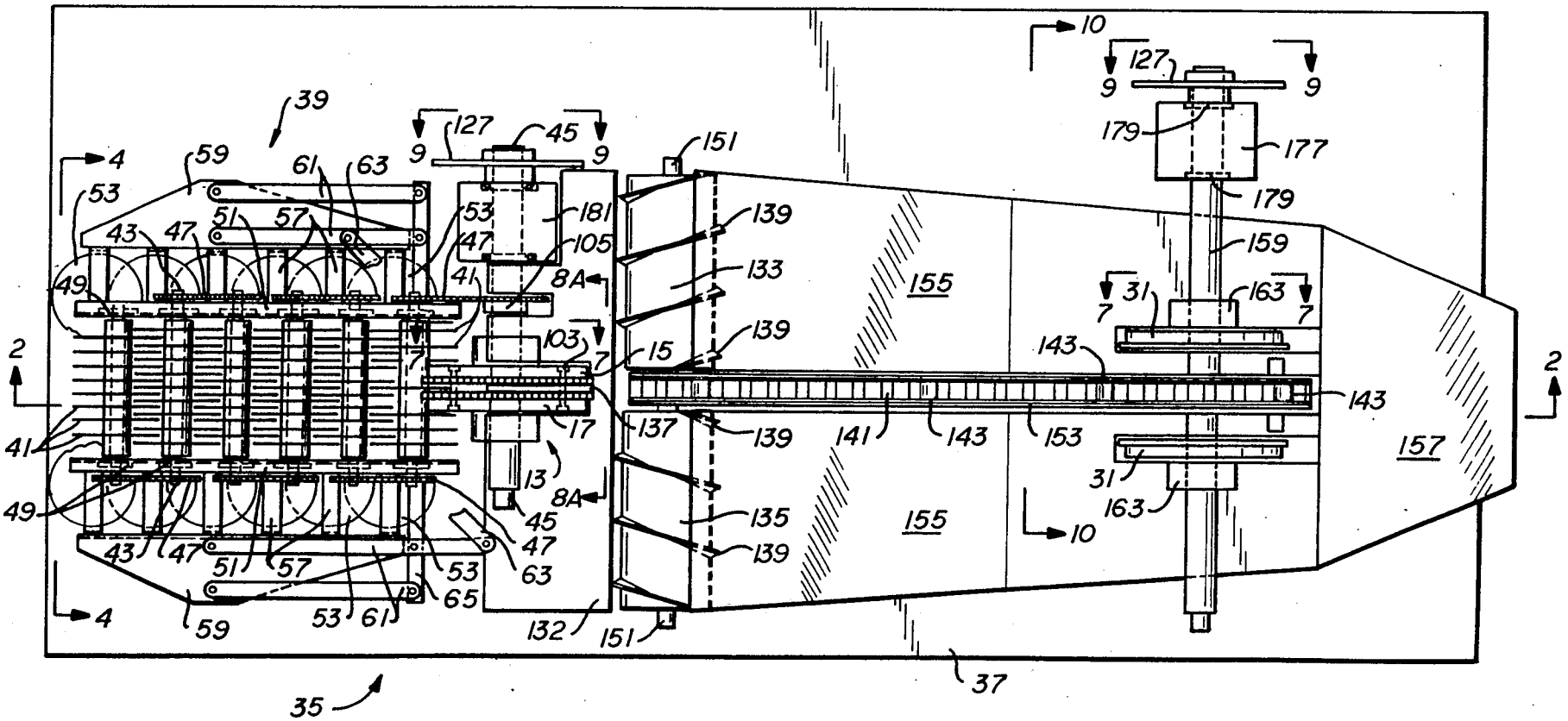
FIG. 3 is a top view of the shearing apparatus taken along lines 3—3 of FIG. 2.

Now referring to FIGS. 2 and 3, the shearing machine 35 is seen mounted on a trailer 37. A scrap tire is brought to the first rotary shear 13 by a compression conveyor 39. Two rows of compression rollers 41 are arranged to form a V-shaped compression assembly. FIG. 3 illustrates the rows of rollers as consisting of seven, eight or nine compression rollers 41 in various rows, but the number of rollers in a row is not critical.

A scrap tire is inserted into the compression conveyor 39 in an upright position, in relation to the side view of FIG. 2. The compression rollers 41 are sawtooth and the rows of rollers are each fixed to a rotating shaft 43 to carry the tire in the direction of the first rotary shear 13. The directions of compression roller rotation are indicated by Arrows A and B.

The compression roller shafts 43 are powered by rotation of the shear drive shaft 45 through a number of chains or belts 47 and are supported on bearings 49 within frames 51. The manner of providing rotational power to the shear drive shaft 45 is described below.

The V-shaped compression assembly grasps any common size tire to advance the tire in an upright position toward the first rotary shear 13. As the tire moves into the assembly, the configuration of the assembly will provide compression force to the tread area on opposing sides of the tire's circumferential periphery. Preferably, the tire will be compressed to a size of approximately 6–8 inches before the first rotary shear 13 cuts the tire through the tread area.

The compression conveyor 39 also includes a gripper assembly which grips the side walls of a tire. The gripper assembly centers a tire progressing through the compression conveyor. The assembly is comprised of a plurality of gripper rollers 53 on gripper roller shafts 55.

The gripper roller shafts 55 are arranged in a pair of parallel lines, as shown in FIG. 3. Each gripper roller shaft is attached to a brace arm 57 and the brace arms are fixed to frames 59. The frames 59 are spring biased, not shown, so that the frames are urged toward each other. For example, the frames may be biased into a closed position by a helical spring connecting the frames. Radius arms 61 and cross-braces 63 and 65 ensure that frames 59 work to center tires. The radius arms 61 are pivotably mounted to the frames 59 and cross-braces 63 and 65. The parallel rows of gripper roller shafts 55 are typically in a closed position with the gripper rollers 53 being spaced apart by approximately three inches; but for the purpose of clarity, FIG. 3 shows cross-brace 63 in a split condition and the frames 59 and gripper rollers 53 in an open position.

Referring particularly to FIG. 2, the gripper roller shafts 55 closest to the first rotary shear 13 provide less support for gripper rollers 53 than do shafts further from the first rotary shear. This arrangement is to accommodate the V-shape configuration of the compression roller assembly. Thus, the conveyor assembly 39 acts as a funnel for the first rotary shear 13. The gripper roller shafts 55 are interconnected by belts or chains 67 to synchronize shaft rotation. Arrows C indicate the direction of rotation for the shafts.

Figure 4:
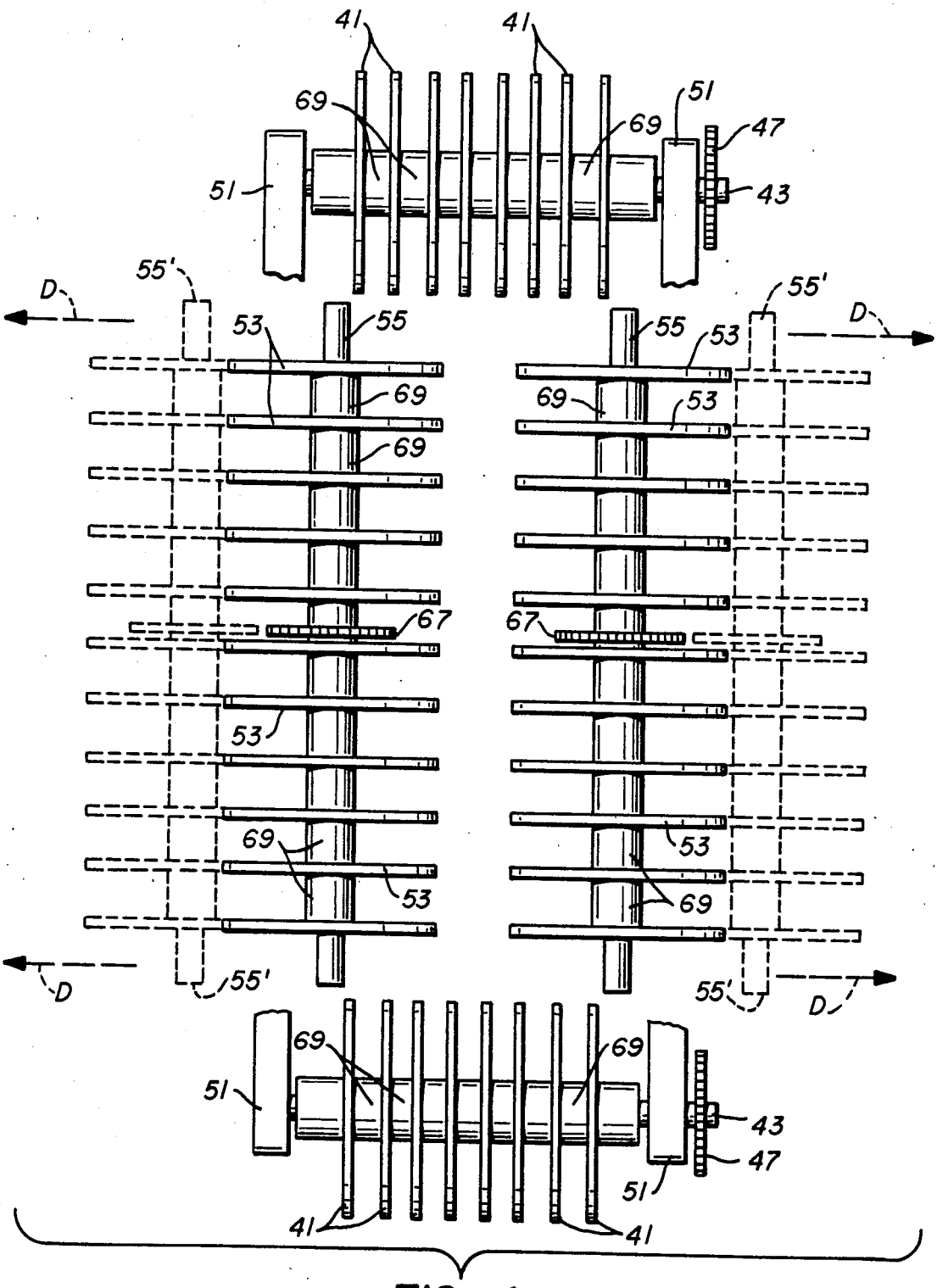
FIG. 4 is a front view of a compression conveyor of the present invention taken along lines 4—4 in FIGS. 2 and 3.

Referring now to FIG. 4, a scrap tire is inserted into a compression conveyor in an upright position. In this manner, the treaded area of the tire will contact the compression rollers 41 and the side walls of the tire will contact the gripper rollers 53. FIG. 4 shows only those compression rollers and gripper rollers furthest from the first rotary shear. Each roller 41 and 53 is spaced apart from an adjacent roller by a spacer hub 69. The spacer hubs 69 are preferably two inches in length.

Because the gripper rollers 53 of opposed shafts 55 are normally only three inches apart, insertion of a scrap tire into the compression conveyor will urge the shafts 55 in the direction of Arrows D to an open position 55'. The range of movement is dictated by the width of the tire. The gripper rollers will center a tire in the compression conveyor 39. Centering is important since a tire exiting the conveyor enters the first rotary shear with a bead wire on each side of the shear cut. The gripper rollers 53 are also effective in moving a tire too small to contact the upper and lower sawtooth rollers 41 of the V-shaped compression assembly.

Figure 5:
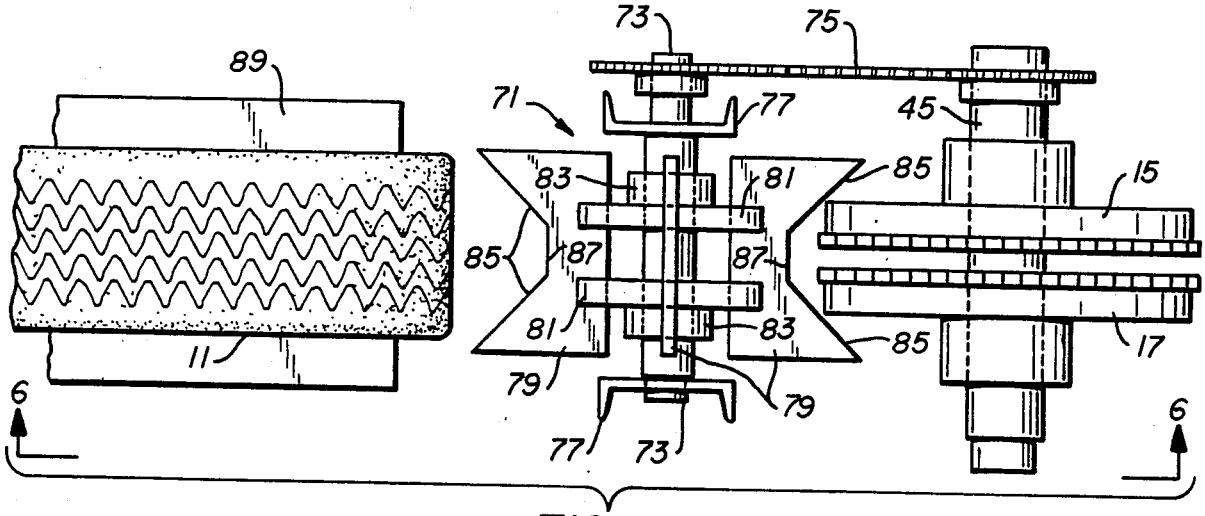
FIG. 5 is a top view of an alternative embodiment of the compression conveyor of FIG. 4.
Figure 6:
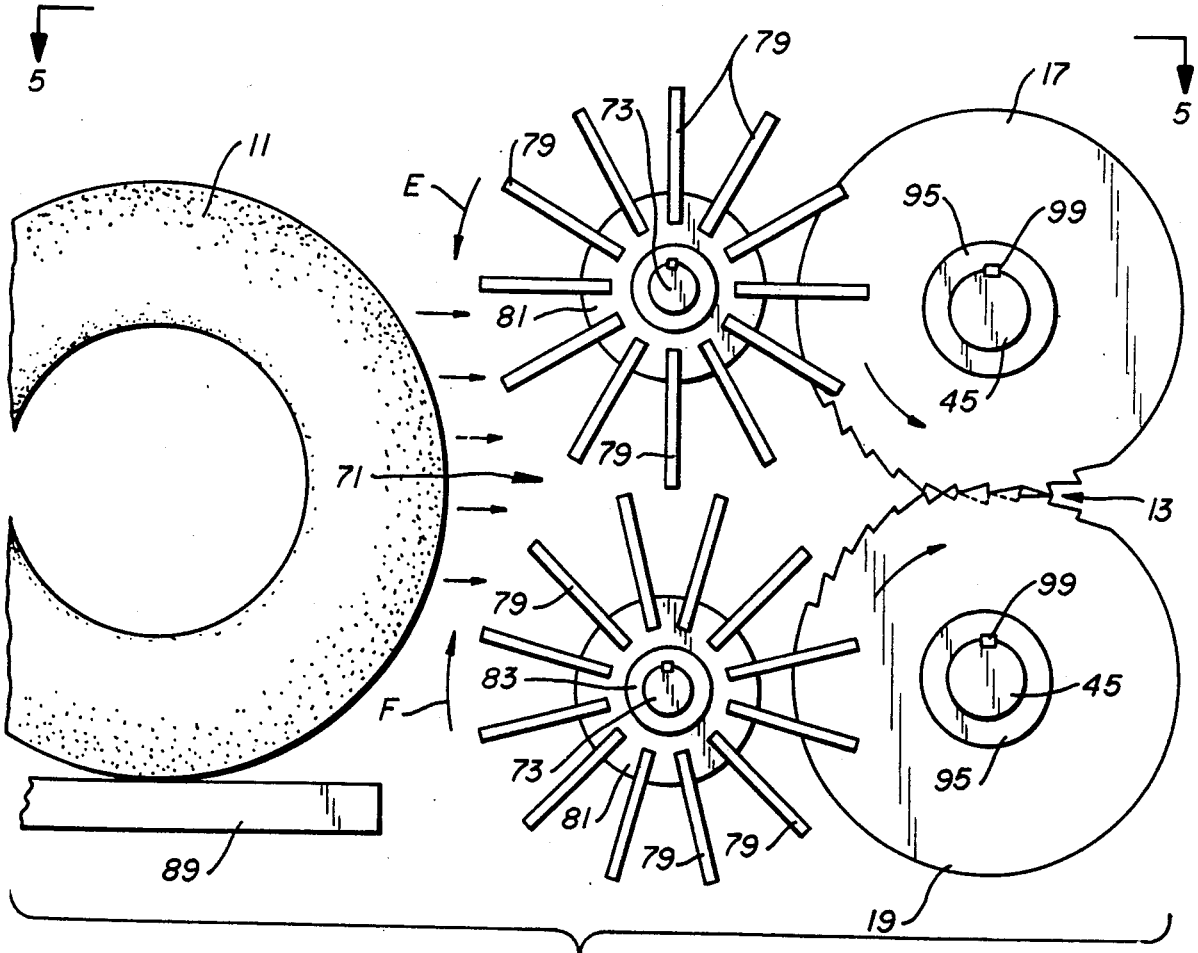
FIG. 6 is a side view of the compression conveyor of FIG. 5 taken along lines 6—6.

FIGS. 5 and 6 illustrate an alternative embodiment of the compression conveyor of the present invention. The paddle compression conveyor 71 has a pair of paddle shafts 73 rotatably driven by a chain 75 linked to the shear drive shaft 45. The counterrotation of the paddle shafts is indicated by Arrows E and F. Flanged bearings 77 are fixed to a frame, not shown, to ensure that the paddle assemblies remain in place.

Flat paddles 79 are welded into notched wheels 81 which are carried on bearings 83. Each paddle 79 has an outer periphery having two sloped edges 85 and a flattened center 87 to define a U-like opening for acceptance of a scrap tire 11.

In operation, an upright tire 11 is rolled along a platform 89 into the paddle compression conveyor 71. The sloped edges 85 of the paddles 79 will grasp the tire to advance the tire into the first rotary shear 13. The paddles 79 provide a compression force to the thread area of the tire, compressing the tire to approximately six inches before the tire reaches the first rotary shear.

Figure 7:
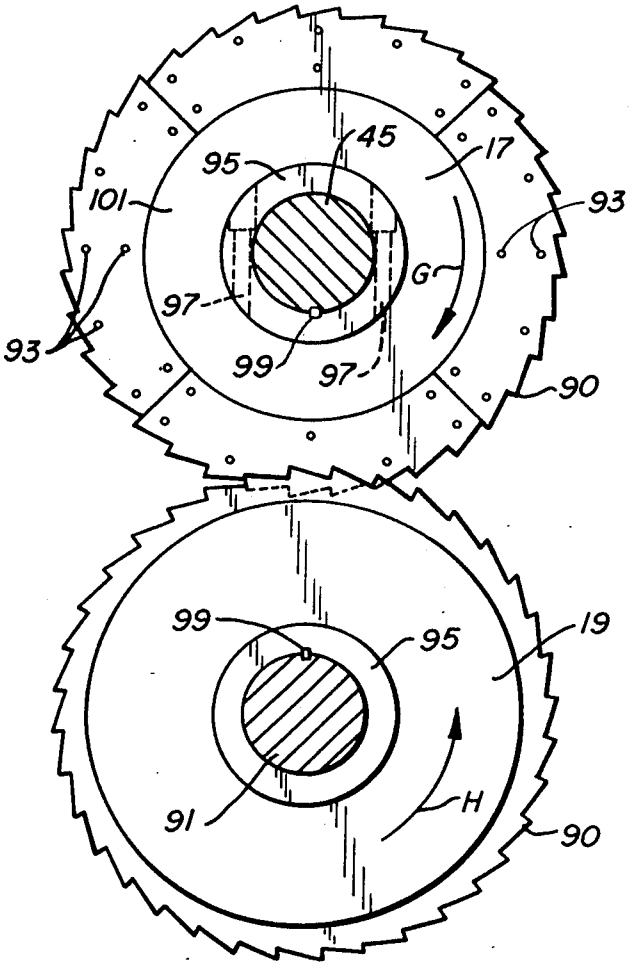
FIG. 7 is a side view taken along lines 7—7 of FIG. 3.
Figure 8B:
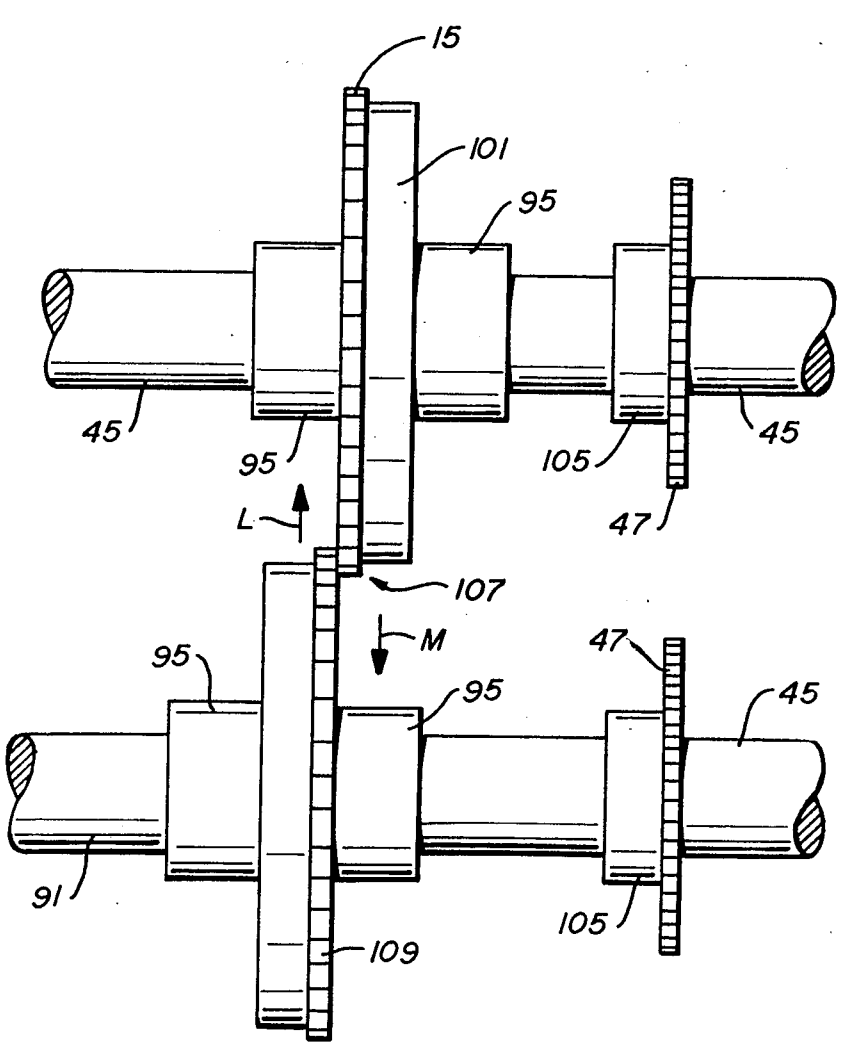
FIG. 8B is a rear view of an alternative embodiment of the apparatus of FIG. 8A.
Figure 8A:
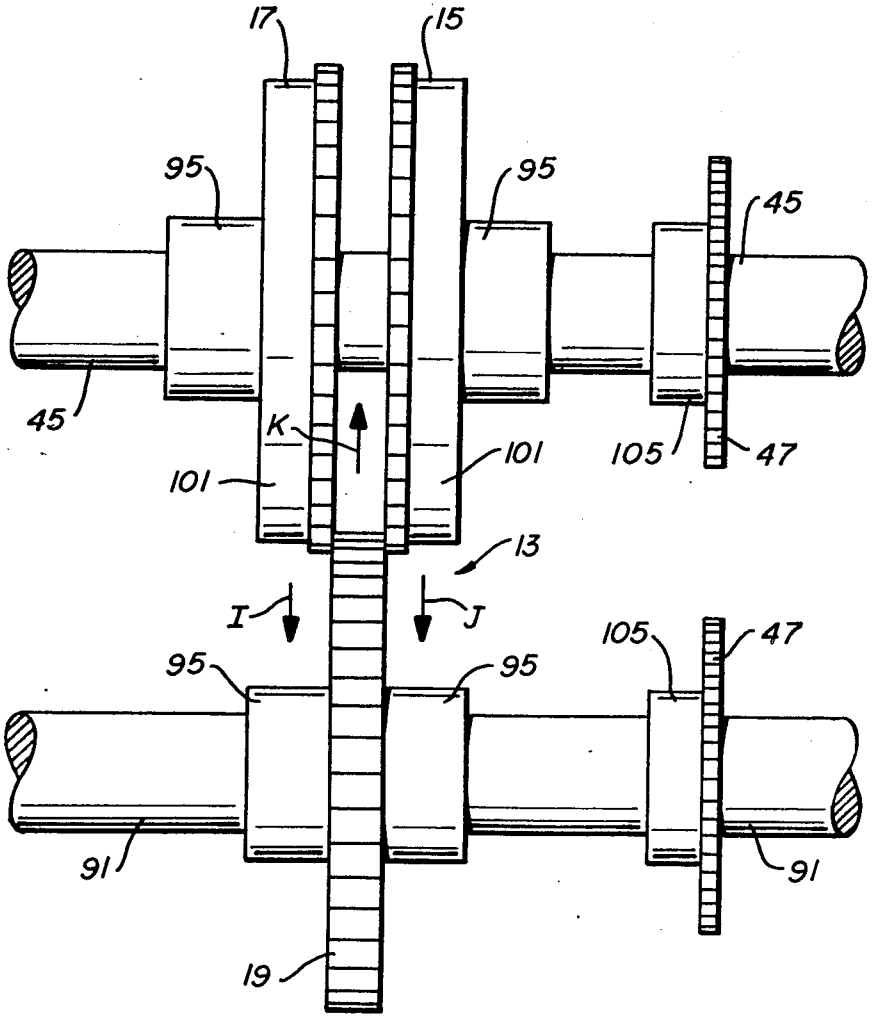
FIG. 8A is a rear view taken along lines 8A—8A of FIG. 3.

Referring to FIGS. 7 and 8A, shears 15 and 17 are driven in the opposite direction of the lower shear 19, as indicated by Arrows G and H. The shears 15, 17 and 19 are sawtoothed in profile, like huge saw blades, having hardened steel members 90 as cutters. The shears have an annular formation and are supported upon a pair of parallelly disposed shafts 45 and 91 with the counterrotating shears in a contacting relation. The sawtooth periphery of the shear 17 may be sectionally changed by removal of bolts 93. The shears are held in place by bearings 95 which are secured by bolts 97 and drive keys 99.

The upper shears 15 and 17 have outer flanges 101. Referring briefly to FIG. 3, the upper shears 15 and 17 are prevented from moving away from the middle shear 19, not shown, by bolts 103.

Optimally, the shear 19 is one to two inches in width and is in contacting relation with the shears 15 and 17. To function properly the spacing between the shear 19 and shears 15 and 17 should not exceed 0.003 inches.

Shafts 45 and 91 may be rotated from between zero and twenty revolutions per minute. It has been found that rotation at 9.5 rpm is best for blade life preservation. Since sprockets 105, which drive chain 47, are keyed to the shafts 45 and 91, the compression conveyor 39 will be moved at the same speed as the shears.

The compression conveyor feeds an upright tire into the first rotary shear 13. The rotary shear 13 makes a pair of cuts about the circumferential periphery of the tire. The still intact side walls are displaced in the direction of Arrows I and J while the crown portion is displaced in the direction of Arrow K.

FIG. 8B illustrates an alternate embodiment of the first rotary shear. The first rotary shear 107 of FIG. 8B includes only two shears 15 and 109. The shear 109 has the same construction as shear 17 of FIG. 8A, but because shaft 45 now carries one shear 15 the rotary shear 107 will make one peripheral cut, rather than two. The side wall halves of the segmented tire will travel in the direction of Arrows L and M.

Figure 9:
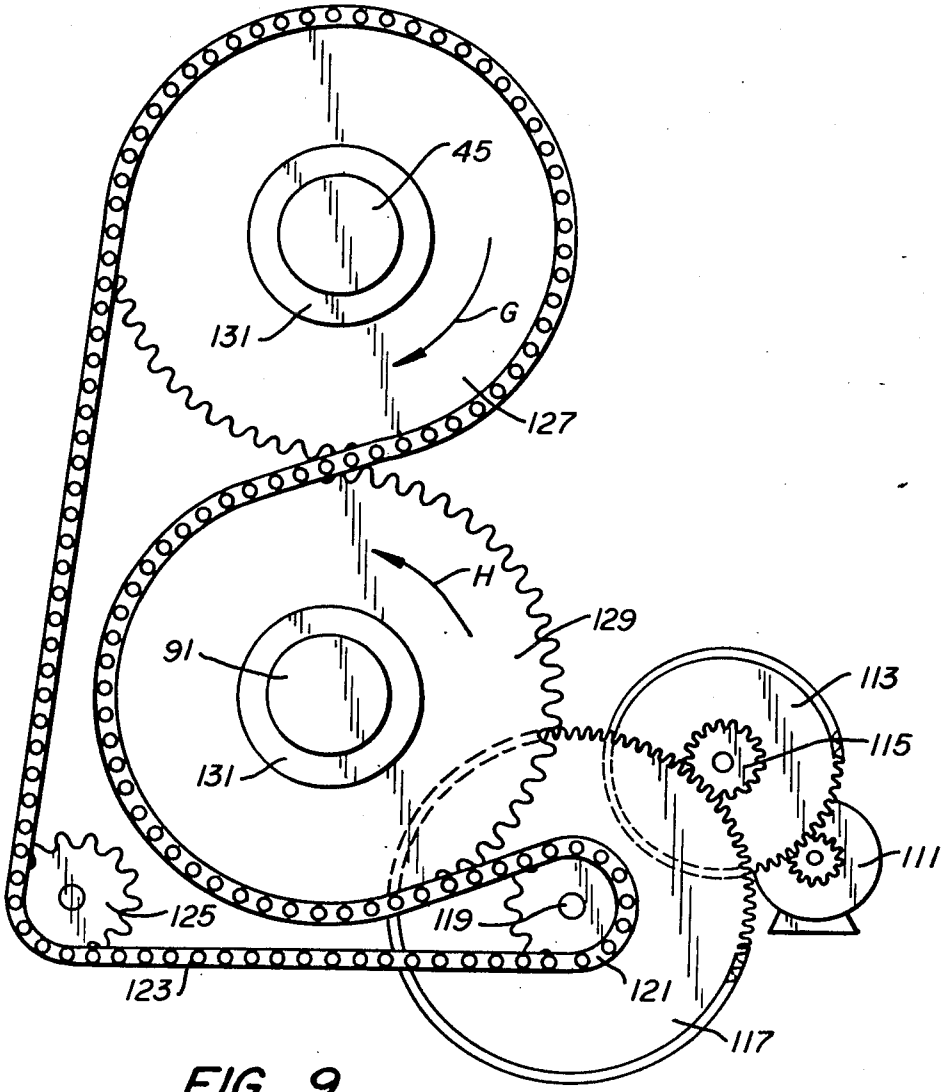
FIG. 9 is a side view taken along line 9—9 of FIG. 3.

The means for driving the shear shafts 45 and 91 is seen in FIG. 9. An electric, gasoline or diesel motor 111 is connected to a ten-to-one gear box 113. The gear box 113 has a sprocket 115 that intermeshes with the teeth of a large sprocket 117 that is keyed to the shaft 119 of a drive sprocket 121. The drive sprocket 121 powers a drive chain 123.

The drive chain 123 is laced about an adjustment idler gear 125 and drive gears 127 and 129 that are keyed to shear shafts 45 and 91. Thus, synchronized counterrotation of the shafts 45 and 91 is ensured. Power transmission from one shaft to another is not necessary since one chain 123 powers both shafts 45 and 91. One motor 111 of less than 30 hp is sufficient. Adjustment idler gear 125 may be repositioned for proper tension of the drive chain 123. The drive gears 127 and 129 are keyed to the respective shafts 45 and 91 through bearings 131.

Referring again to FIGS. 2 and 3, after a scrap tire has been cut by the first rotary shear 13, the tire segments fall by gravity from the first rotary shear into a hopper 132 where the segments are centered by auger flights 133 and 135. The back sheet 137 of the hopper extends into the first rotary shear 13 to plow out segments from between the adjacent shears 15 and 17.

The spirals 139 of the rotating auger flights 133 and 135 impel the tire segments into an endless loop chain 141 having a plurality of hooks 143. The endless loop chain is trained about sprockets 145, 147 and 149. Sprocket 149 is keyed to a shaft 151 and auger flights 133 and 135 are coaxially mounted to the shaft 151 so that movement of the chain, as shown by Arrows N, will drive the auger flights.

The inner circumference of a tire segment is grasped by a chain hook 143. The hooks 143 extrude through a slot 153 in a drag pan 155. The drag pan 155 provides friction to center a tire segment so that tire segments terminate equidistant between a second rotary shear 27 and a third rotary shear 29. In this manner, each tire segment is cut into four arcuate sections. The arcuate sections of the tire then slide down a chute 157 to a radial stacking conveyor, not shown.

Figure 10:
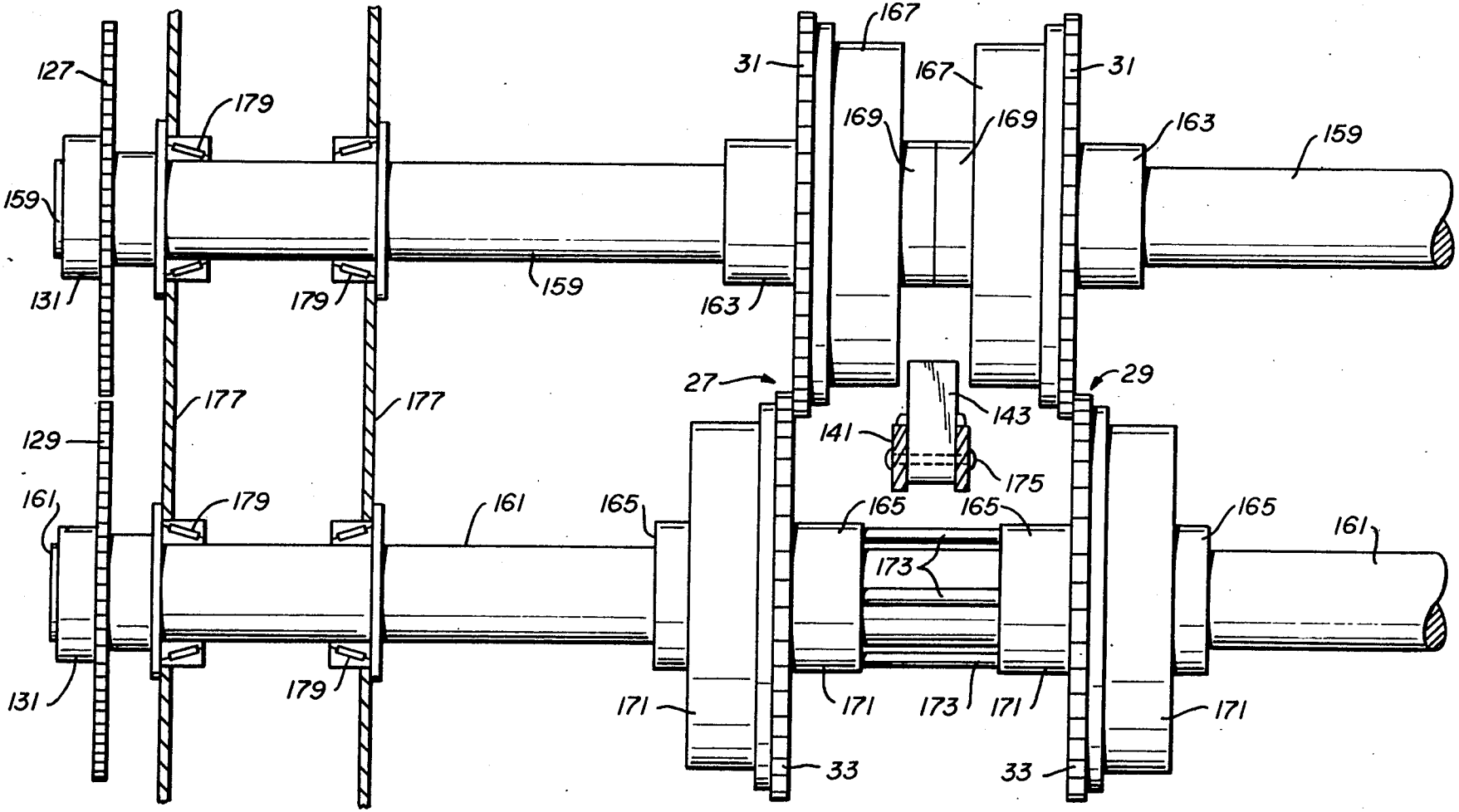
FIG. 10 is a front view taken along lines 10—10 of FIG. 3.

This quartering process may be seen in FIG. 10. The second rotary shear 27 and the third rotary shear 29 each have an upper shear 31 and a lower shear 33. Each rotary shear 27 and 29 works in the same manner as the offset rotary shear shown in FIG. 8B. That is, the upper shear 31 is in contacting relation to the lower shear 33. The shears 31 and 33 have sawtooth blades and are keyed to parallel shafts 159 and 161 through bearings 163 and 165. The upper shears 31 have a flanged portion 167 and are spaced apart by spacer hubs 169. Likewise, the lower shears 33 have a flanged portion 171. Studs 173 passing through bearings 165 may be tightened, thereby providing a means of maintaining a zero clearance between shears 31 and 33 after the shears have been worn or sharpened. Clearance between shears 31 and 33 should not exceed 0.003 inches.

An annular tire segment is pulled into the second rotary shear 27 and third rotary shear 29 by a chain hook 143. The chain hook is secured to the chain 141 by a bolt 175.

The manner of driving the shafts 159 and 161 is identical to that of driving the shafts of the first rotary shear 13, as described with reference to FIG. 9. A drive chain is trained about drive gears 127 and 129 to rotate the drive gears in a counterrotational fashion at approximately 10 rpm. The drive gears 127 and 129 are keyed to the shafts through bearings 131.

FIGS. 3 and 10 show that the shear shafts 159 and 161 are cantilevered from a station 177. The shafts 159 and 161 are each secured to the station 177 by a pair of bearings 179. Likewise, the shear shafts of the first rotary shear 13 are cantilevered from a station 181.

The three rotary shears 13, 27 and 29 will combine to shear a tire into at least eight arcuate pieces which translates into a storage and volume reduction of better than 50 percent. These pieces are now suitable for fine reduction in other equipment.

I claim:

1. An apparatus for shearing tires comprising, compression means for exerting a flattening force on a circumferential periphery of a tire, first shearing means communicating with said compression means for receiving a flattened tire therefrom and having at least two rotary mounted circular shears disposed to shear the flattened tire about the circumferential periphery to form at least two annular tire segments, and second and third shearing means communicating with the first shearing means adapted to accept an annular tire segment therefrom, said second and third shearing means sharing a parallel pair of common axes and each having a pair of counterrotating shears disposed to shear said annular tire segment perpendicular to an axis extending through the center of the tire segment, the third shearing means spaced apart from the second shearing means by a distance less than the outer diameter of said annular tire segment, said second and said third shearing means combining to shear an annular tire segment into four arcuate parts.

2. The apparatus of claim 1 wherein said first shearing means has first and second circular shears, said first shear supported by a first shaft, said second shear supported by a second shaft parallel said first shaft, said first shaft spaced apart from said second shaft by a distance less than a radius of said first shear.

3. The apparatus of claim 1 wherein said first, second and third shearing means are rotary shears.

4. The apparatus of claim 2 wherein said first shearing means further includes a third circular shear coaxial with said first shear and spaced apart from said first shear by said second shear, said first shearing means forming three annular tire segments when a flattened tire is received into said first shearing means.

5. The apparatus of claim 1 wherein said second shearing means includes fourth and fifth shears supported upon a pair of parallel shafts, said fourth shear supported by a third shaft, said fifth shear being supported by a fourth shaft and in contacting relation to said fourth shear.

6. The apparatus of claim 5 wherein said third shearing means includes a sixth and a seventh shear, said sixth shear supported by said third shaft, said seventh shear supported by said fourth shaft and in contacting relation to said sixth shear.

7. The apparatus of claim 1 wherein said compression means is a compression conveyor having a compression assembly, a gripper assembly and a drive means, said compression assembly having a plurality of parallel compression roller shafts aligned in a V-shaped configuration, each compression roller shaft having a plurality of coaxial compression rollers, said gripper assembly having a plurality of parallel gripper roller shafts disposed perpendicular to said compression roller shafts, each gripper roller shaft having a plurality of coaxial gripper rollers, said gripper roller shafts aligned in a pair of rows on opposed sides of said V-shaped compression assembly to form a funnel-like conveyor to said first shearing means, said gripper assembly having a means for biasing said pair of rows in the direction of each other.

8. The apparatus of claim 1 wherein said compressing means is a compression conveyor having a first and second paddle assembly, each paddle assembly having a plurality of paddles and a rotatably mounted paddle shaft, said paddles of each paddle assembly having a first side coaxially fixed to said paddle shaft, each paddle having a second side opposed said first side, said second side having downwardly sloped edges and a flat bottom to form a U-like configuration for accepting the circumferential periphery of a tire, said first and second paddle assemblies parallelly spaced apart and disposed to center a tire for acceptance by said first shearing means.

9. The apparatus of claim 1 further comprising a conveyor means disposed between said first shearing means and said second and third shearing means, said conveyor means having a means for centering said annular tire segments between said second and said third shearing means.

10. The apparatus of claim 5 wherein the clearance between said fourth and fifth shears is in a range of 0.00 inches and 0.003 inches.

11. An apparatus for shearing tires of the type having tread about a circumferential periphery and a center defining a tire axis comprising, a compression conveyor having a compressing means for exerting force on said circumferential periphery perpendicular said tire axis to flatten said tire, said compression conveyor having a gripping means for positioning said tire within said compression conveyor, a first rotary shear disposed to accept said flattened tire from said compression conveyor, said first rotary shear having at least two circular shears including a first shear and a second shear separately supported upon a pair of parallelly disposed counterrotating shafts spaced apart by a distance less than a radius of said first shear, said first shear and said second shear disposed to cut said circumferential periphery of the flattened tire to form two annular tire segments, and a second and third rotary shear communicating with the first rotary shear and each shear having a pair of circular quartering shears separately supported on a third and a fourth counterrotating parallel shaft, said third and fourth shafts spaced apart by a distance less than a radius of said quartering shears, said first pair of quartering shears disposed to shear an annular tire segment perpendicular to said tire axis, the third rotary shear parallel said second rotary shear and spaced apart therefrom by a distance less than the diameter of said annular tire segments.

12. The apparatus of claim 11 wherein said first rotary shear has a third circular shear, said first shear and said third shear coaxially mounted to a first shaft of said pair of shafts and spaced apart by said second shear, said first rotary shear disposed to cut said circumferential periphery of the bent tire to form three annular tire segments.

13. The apparatus of claim 12 wherein said first and second circular shears have first sides spaced apart from each other by a distance within the range of zero to 0.003 inches, said second shear having a second side and said third shear having a first side spaced apart from said second side of the second shear by a distance within the range of zero to 0.003 inches.

14. The apparatus of claim 11 wherein said first pair of circular quartering shears have sides spaced apart from each other by a distance within the range of zero to 0.003 inches and said second pair of quartering shears have sides spaced apart from each other by a distance within the range of zero to 0.003 inches.

15. The apparatus of claim 11 wherein said first shear is supported on a first shaft and said second shear is supported on a second shaft, said first shaft having a coaxially mounted first drive gear, said second shaft having a coaxially mounted second drive gear, and a drive means having a drive chain meshing with said first and said second drive gears to counterrotationally rotate said first and second shafts.

16. The apparatus of claim 11 wherein said compression conveyor includes a plurality of rotatable compression shafts and a plurality of rotatable gripping shafts, said compression shafts each supporting a plurality of compression rollers, said gripping shafts each supporting a plurality of gripping rollers, said compression shafts disposed perpendicularly said gripping shafts, said compression shafts and said gripping shafts combining to form a funnel-like configuration.

17. The apparatus of claim 11 further comprising a conveyor means disposed between said first shearing means and said second and third shearing means, said conveyor means having a means for centering said annular tire segments between said second and said third shearing means.

18. The apparatus of claim 11 supported upon a mobile trailer.

19. A method of shearing automotive tires of the type having tread about a circumferential periphery and a center defining a tire axis comprising, flattening a tire by circumferential pressure thereby bringing opposed tread regions into proximity, shearing the flattened tire about its circumferential periphery, thereby forming two annular tire sections, and shearing each annular tire section into at least two pieces by cutting across the tire tread.

20. The method of claim 1 further defined by shearing the flattened tire about its circumferential periphery with two slightly spaced parallel cuts forming three annular pieces.

21. The method of claim 20 further defined by shearing each annular section into at least four pieces by cutting across the tire tread.

* * * * *

UNITED STATES PATENT AND TRADEMARK OFFICE

CERTIFICATE OF CORRECTION

PATENT NO. : 4,682,522

DATED : July 28, 1987

INVENTOR(S) : Randel L. Barclay

It is certified that error appears in the above—identified patent and that said Letters Patent is hereby corrected as shown below:

Column 3, lines 8-9, "of a mobile shearing apparatus in the present invention" should read - -of a mobile shearing apparatus in accord with the present invention- -.

Claim 20, column 10, line 13, "The method of claim 1" should read - -The method of claim 19- -.

Signed and Sealed this

First Day of March, 1988

*Attest:*

DONALD J. QUIGG

*Attesting Officer*

*Commissioner of Patents and Trademarks*